United States Patent [19]

Goetz

[11] Patent Number: 4,708,300

[45] Date of Patent: Nov. 24, 1987

[54] APPARATUS FOR FEEDING A MACHINE WITH A PLURALITY OF WEBS OF MATERIAL FROM A PLURALITY OF WEB SUPPLY ROLLS

[75] Inventor: Willi Goetz, Seeheim, Fed. Rep. of Germany

[73] Assignee: Valmet-Strecker GmbH, Pfungstadt, Fed. Rep. of Germany

[21] Appl. No.: 3,505

[22] Filed: Jan. 15, 1987

[30] Foreign Application Priority Data

Jan. 17, 1986 [DE] Fed. Rep. of Germany ..... 3601297

[51] Int. Cl.[4] ..... B65H 19/18

[52] U.S. Cl. ..... 242/58.1; 242/58.6; 414/911

[58] Field of Search ..... 242/58.6, 79, 58, 58.1, 242/58.3, 55, 58.2; 414/911

[56] References Cited

U.S. PATENT DOCUMENTS

| | | | |
|---|---|---|---|
| 2,011,808 | 8/1935 | Flaherty | 242/79 X |
| 2,738,138 | 3/1956 | Russell | 242/79 |
| 2,991,023 | 7/1961 | O'Brien | 242/79 |
| 3,695,532 | 9/1972 | Lindstaedt | 242/58.6 X |
| 3,695,539 | 10/1972 | Lindstaedt | 242/79 X |
| 4,386,741 | 6/1983 | Weiss et al. | 242/58.6 |

FOREIGN PATENT DOCUMENTS 2033389 3/1971 Fed. Rep. of Germany .

*Primary Examiner*—Stuart S. Levy
*Assistant Examiner*—Steve Dubois
*Attorney, Agent, or Firm*—Karl F. Milde, Jr.

[57] ABSTRACT

The invention relates to apparatus for simultaneously feeding a machine with webs of material from a plurality of web supply rolls, the rolls being mounted in tandem with their winding axes parallel to one another between roll stands situated opposite one another in pairs, and a loading car for carrying new rolls which runs between the bilateral roll stands. To hasten the roll changing procedure, the loading car is capable of receiving simultaneously the entire number of mountable rolls with a spacing between them corresponding to the spacing of the successive roll mounting axes. For this purpose, there are provided automatically operating means for carrying away the roll cores released from the respective roll stands, and means for holding the ends of the indrawn webs of material which can be lowered automatically onto the circumferencial surfaces of the web rolls, and which are combined with means for severing the respective webs of material. A roll preparation section with a loading station is preferably provided ahead of the track carrying the loading car.

21 Claims, 6 Drawing Figures

APPARATUS FOR FEEDING A MACHINE WITH A PLURALITY OF WEBS OF MATERIAL FROM A PLURALITY OF WEB SUPPLY ROLLS

BACKGROUND OF THE INVENTION

The invention relates to an apparatus for feeding a machine with a plurality of webs of material from a plurality of web supply rolls. More particularly, the invention relates to an apparatus having a plurality of roll stands, positioned opposite one another in pairs, with each pair adapted to rotatably support a single web supply roll. The roll stands are arranged to hold a plurality of web supply rolls with their spool axes in parallel.

Apparatus of this type is already known in which previously unpacked and inspected new web rolls can be supplied successively to successive pairs of roll stands from a loading car carrying only one roll at a time. To change rolls, the operator stops the machine that is to be fed, severs the webs of material manually close to the roll core, carries the cut ends to web holding means in the form of suction cups disposed fixedly overhead, removes the roll cores from the released roll holding means, carries the new rolls successively to the pairs of stands by means of the loading car, raises each roll to the level of the roll holding means, clamps it on, brushes it with an adhesive at an appropriate point on the roll circumference or applies to this surface a double-sided adhesive tape, takes the corresponding cut web ends from the web holding means and presses them against the prepared point of adhesion on the roll circumference in order thus to produce a splice. This entire roll changing procedure takes a relatively large amount of time which is lost to production.

The invention is addressed to the problem of considerably reducing the lost time due to roll changing in an apparatus of the kind described above.

SUMMARY OF THE INVENTION

This object, as well as other objects which will become apparent from the discussion that follows, are achieved, according to the present invention, by providing, in a web feeding apparatus of the above mentioned type, a loading car for carrying the new rolls which runs between the bilateral roll stands. To hasten the roll changing procedure, the loading car is capable of receiving simultaneously the entire number of mountable rolls with a spacing between them corresponding to the spacing of the successive roll mounting axes. For this purpose, there are also provided, in accordance with the invention, automatically operating means for carrying away the roll cores released from the respective roll stands, and means for holding the ends of the indrawn webs of material, which can be lowered automatically onto the circumferential surfaces of the web rolls, and which are combined with means for severing the respective webs of material. A roll preparation section with a loading station is preferably provided ahead of the track carrying the loading car.

The loading cars which simultaneously present the entire number of rolls needed at the desired point and at the necessary level, the automatic roll core removal and the automatically operating means for severing and holding the cut ends so that the webs can also be spliced automatically, together make it possible to reduce to a fraction the time previously needed for multiple roll changing.

As a result of this arrangement, as well as other, particular features which will be described in detail below, some of which permit additional savings of time, it is thus possible to reduce the total amount of time needed for roll changing down to about 2 minutes.

For a full understanding of the present invention, reference should now be made to the following detailed description of the preferred embodiments of the invention and to the accompanying drawings.

DESCRIPTION OF THE PREFERRED EMBODIMENT

Figure 1:
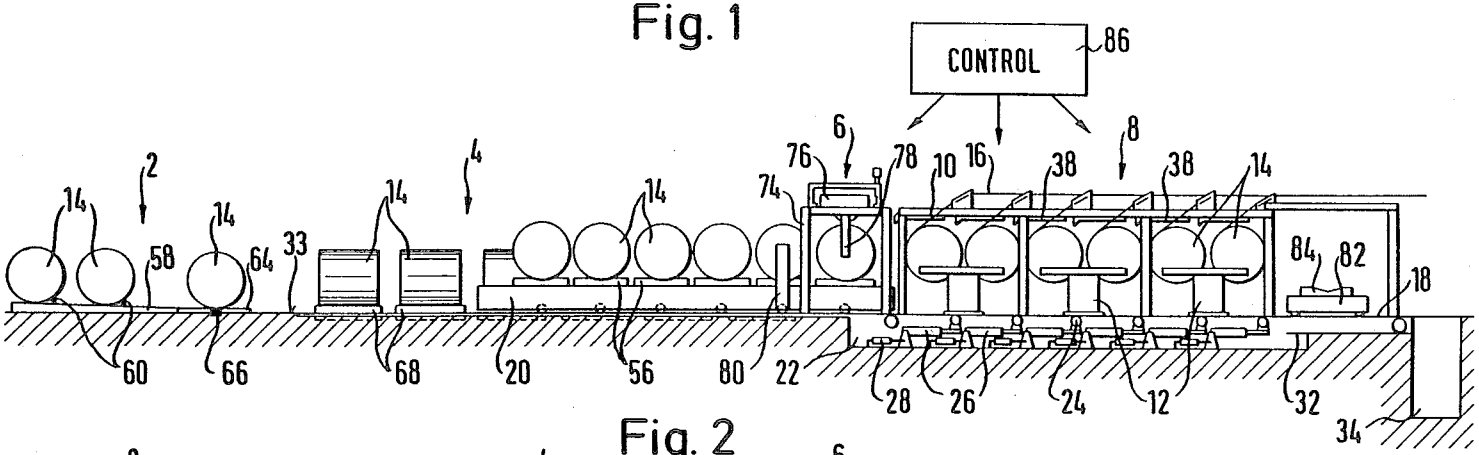
FIG. 1 is a somewhat diagrammatic front elevational view of the feeding apparatus according to the invention together with a roll preparing section and the loading station.

The preferred embodiment of the present invention will now be described with reference to FIGS. 1–6 of the drawings. Identical elements in the figures are designated with same reference numerals.

Figure 2:
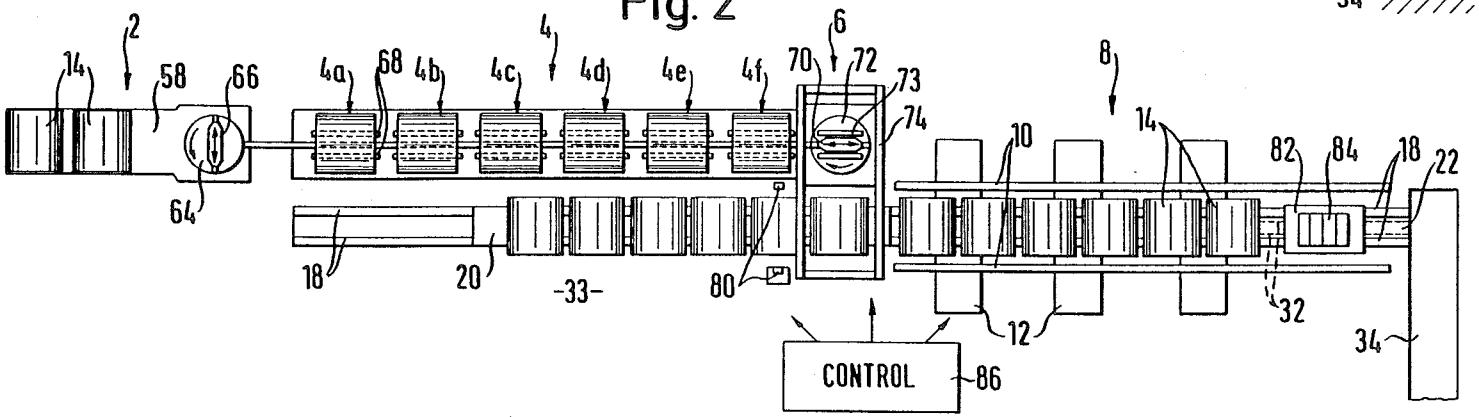
FIG. 2 is a top plan view of the feeding apparatus of FIG. 1, with its roll preparing section and loading station.

FIGS. 1 and 2 show successively, from left to right, a web roll feeding station 2, a roll preparing station 4, a loading station 6, and the actual web feeding apparatus 8 according to the invention.

The web feeding apparatus 8 has a guide roller frame 10 having pairs of roll stands 12 disposed beneath it for, in this example, six web supply rolls 14 for feeding six webs of material 16. Between the roll stands 12 runs a track 18 for a loading car 20, and with the track 18 in the area of the roll stands 12 runs a pit 22, in which a pivoting arm 26 bearing a gripper 24 is associated with each pair of roll stands.

Figure 5:
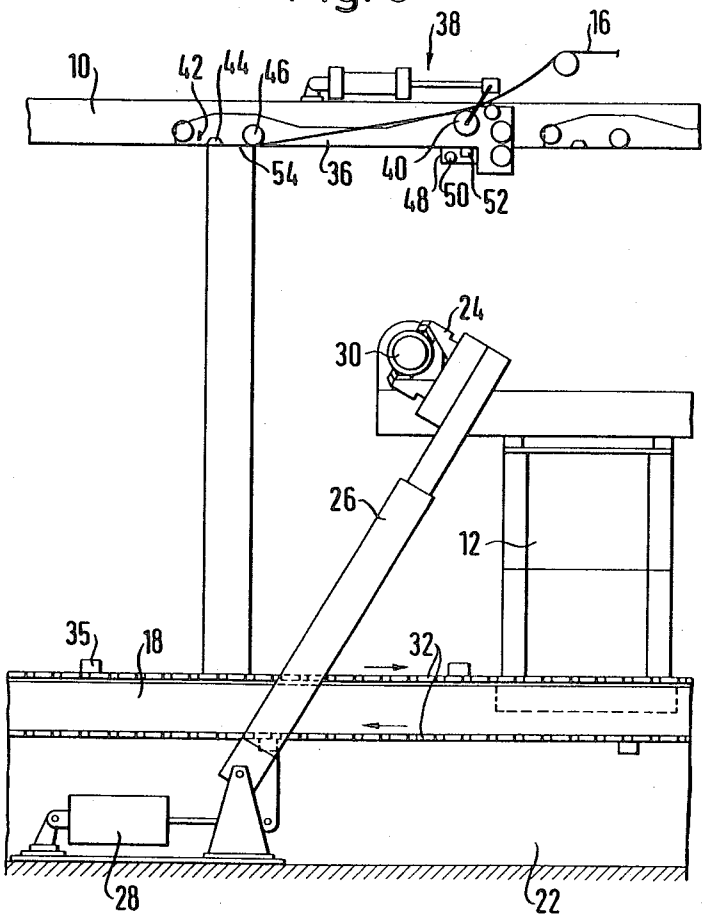

As seen more precisely in FIG. 5, the arms 26, when swung upwardly and extended telescopically, can grasp a roll core 30 by means of their grippers 24, so that, after release by the roll column 12, they can lay it down on two conveyor chains 32 disposed within the track 18 on both sides of the arms 26. The conveyor chains 32, whose lower section runs underneath the floor 33, carry the roll cores 30 to the right in the figures to a collecting pit 34 (FIGS. 1 and 2). For this purpose they have raised cleats 35.

Above each roll stand 12 there is a beam 36, which is pivotally mounted in the guide roller frame 10, of a device 38 for automatically splicing the web of material 16. This beam can pivot downwardly about the axis of the first guide roller 40 toward the roll core 30. As more precisely described in the commonly-owned U.S. patent application Ser. No. 003,502 of Willi Goetz entitled "Device for Automatically Splicing a Web of Material in a Web Feeding Apparatus", filed on the same date as this application, the splicing device 38 has a severing knife 42, a row of suction cups 44, a pressure roller 46 and, on a carriage 48 which can move along the beam 36, a pulley roller 50 and a hollow rod anvil 52 opposite the knife, all extending across the entire width of the web of material.

Figure 4:
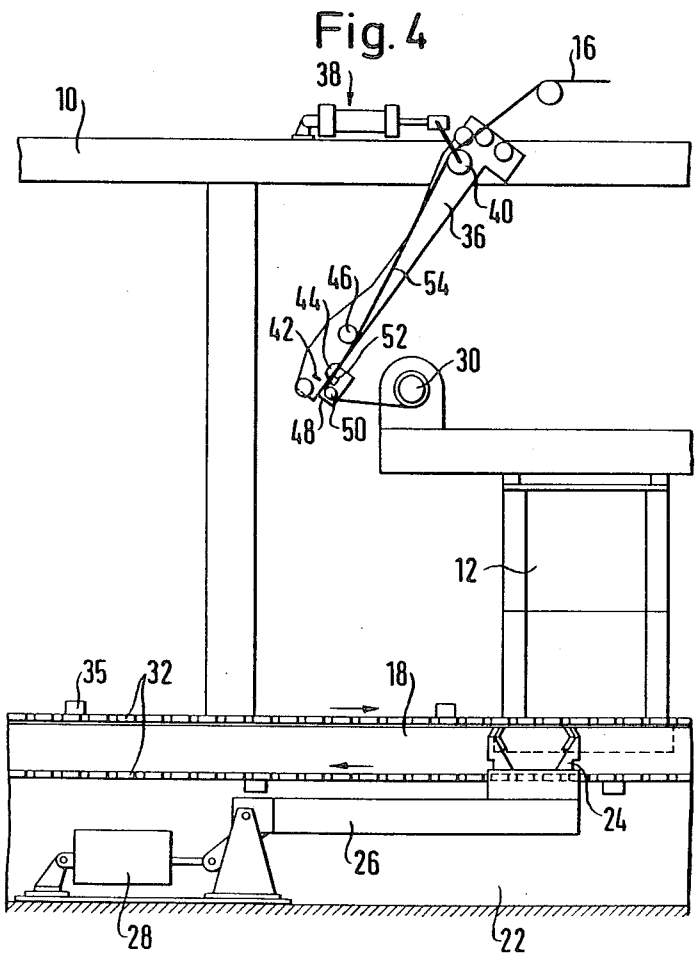
FIG. 3, 4, 5 and 6 are each front elevational views of an enlarged detail from FIG. 1, but at different successive phases of a roll change.
Figure 3:
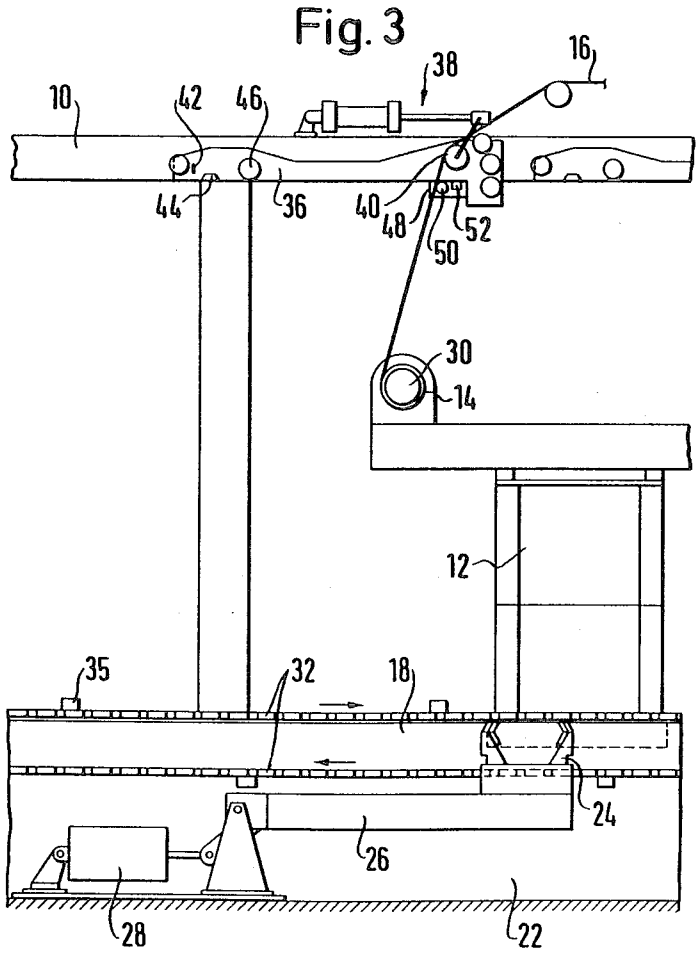

As illustrated in FIG. 4, the beam 36 swings downwardly for the roll change to a point close to the roll core 30, and at the same time the pulley roller 50 produces a deflection of the previously stopped web 16, so that the latter comes to lie between the severing knife 42 and the anvil 52 and also opposite the suction cups 44. The cutter 42, consisting of a knife blade, now moves down against the web, entering into the hollow of the anvil 52, and severs the web. The cut end 54 thus formed on the section of web in the guide roller frame 10 is held by the suction cups 44, while the beam 36 returns to its horizontal starting position, and the carriage 48 returns along the beam to is starting position (FIG. 5). The space underneath the guide roller frame 10 is now free for the changing of the rolls.

The track 18 extends leftward in FIGS. 1 and 2 beyond the guide roller frame 10. The loading car 20 which runs thereon serves to permit all of the supply rolls 14 situated in the feeding apparatus 8 to be changed simultaneously and efficiently. For this purpose it accepts the appropriate number of new supply rolls 14 with the spacing, height and alignment which they are to have in the feeding apparatus 8. After the roll cores 30 of the preceding supply rolls have been carried away, the loading car 20 travels under the guide roller frame 10 and the new supply rolls that are on the car are all mounted in the frame directly and simultaneously. The loading car 20 is equipped with roll carrying tables 56 which can be raised and lowered and which are now lowered in order thus to release the loading car.

Figure 6:
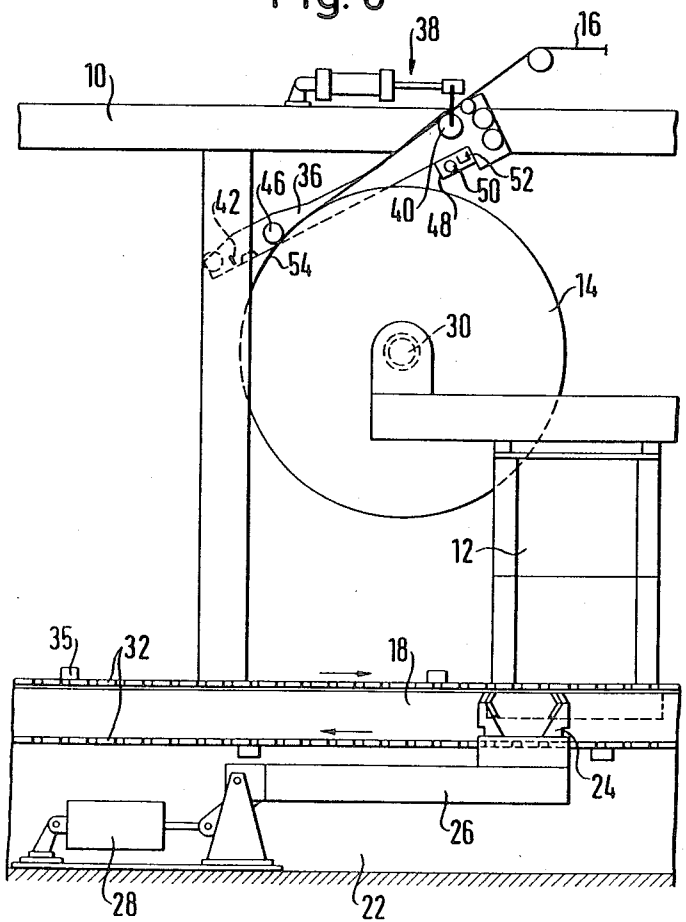

As will be described later on, the new supply rolls 14 were first provided with adhesive at the leading end of their webs or with a double-sided adhesive tape, and they were turned on their roll axes to a position suitable for the splicing of the web. The beam 36 now swings down again onto the new supply rolls 14 held in the roll stands 12 while the cut end 54 held by the suction cups comes to lie on the adhesive under the pressure roller 46 (FIG. 6). As described more in detail in the above-mentioned commonly-owned patent application Ser. No. 003,502. the pressure roller 46 can now perform a reciprocating motion whereby the web end 54 is rolled against the adhesive. When the beam 36 then returns to its horizontal starting position, during which time the suction cups 44 are preferably inactivated, the spliced web of goods of the new roll is on its proper course and can begin to be fed.

In the meantime, the loading car 20 runs out underneath the guide roller frame 10 such that its individual tables 56 come successively into the loading station 6 in order again to take on fresh, prepared web supply rolls. The rolls 14 are first taken in by the roll feed station 2, where they are set down in pairs and rolled down a slightly inclined ramp 58 as soon as they are released by the retractable chocks 60. At the foot of the ramp 58, the roll feeding station 2 has a horizontal turntable 64 into which a small, rail-guided carrying car 66 can enter and by which the axes of web supply rolls can be turned by precisely 90°. The turned supply rolls are brought by the car 66 to successive positions; i.e., roll preparation stations 4*a*–4*f* of the roll preparing section 4. There they are lifted from supporting rollers 68 and the car 66 returns to the roll feeding station 2. The raised rolls are then freed of any damaged outer layers, turned about their respective axes by means of the supporting rollers 68 to the position suitable for the later web splicing operation, and adhesive or preferably a double-sided adhesive strip is applied externally to the leading end of the web of material, as previously mentioned.

The rolls 14 thus successively prepared are also successively carried by an additional small car 70 from the roll preparation section 4 to a horizontal turntable 72 in loading station 6, where their axes are again rotated by 90°. The turntable 72 has a lift table 73 by which the rolls are lifted simultaneously to the level necessary for mounting in the roll stands 12. By means of a gantry 74 with a traveling crane 76 at the loading station, the rotated and lifted rolls 14 are transferred to each of the successive tables 56 of the loading car 20, the car 20 shifting leftward in sense shown in the drawing by one division at a time as each table is brought underneath the roll suspended from a hanger 78 on the traveling crane 76. A level control station 80 disposed alongside the gantry 74 effects a fine adjustment of the height of the roll to the level of the mounting axis.

The loading car 20 thus prepared remains standing outside of the guide roller frame 10 until the next roll change; i.e., until the roll cores 30 of the exhausted web rolls are removed.

Automatic operation of the web feeding apparatus during the entire roll chahge procedure, from the removal of the empty roll cores, through the transfer of the new rolls from the loading car, to the splicing of the ends of the webs of material to the new rolls, is effected by a central control means 86 which operates the hydraulic, electric and pneumatic systems of the apparatus.

As indicated in FIGS. 1 and 2, the feeding apparatus in question also has an unloading car 82, with a single lift table 84, which can also run on the track 18. The unloading car 82 serves for the removal, if necessary, of a single roll 14, such as a defective roll, from the feeding apparatus. Normally it is coupled to the loading car 20 and separated from it only when it is to go into operation. In this case it carries the released roll from the guide roller frame 10 to a point at which it can be removed by an overhead crane or the like.

There has thus been shown and described a novel apparatus for feeding a machine with a plurality of webs of material from a plurality of web supply rolls which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention which is limited only by the claims which follow.

What is claimed is:

1. Apparatus for feeding a machine with a plurality of webs of material from a plurality of web supply rolls, said apparatus comprising, in combination:

(a) a plurality of roll stands, positioned opposite one another in pairs, each pair being adapted to rotatably support a single web supply roll, said roll stands being arranged to support a plurality of rolls with the pool axes in parallel;

(b) a loading car for carrying rolls, arranged to run between the roll stands on both sides and capable of receiving simultaneously the entire number of the rolls which can be mounted in the apparatus, with the spacing of the respective rolls corresponding to that of the successive roll mounting axes in said roll stands;

(c) means for removing the roll cores released from said roll stands;

(d) means, disposed above the rolls mounted on said roll stands, for temporarily holding the ends of the webs of material drawn into the machine during a roll change operation; and (e) a web supply roll preparation section including:

(1) a plurality of successive roll preparation stations arranged adjacent the path of travel of said loading car for the individual preparation of new web supply rolls; and (2) a loading car loading station following said roll preparation stations in succession, for successive transfer of the prepared rolls onto said loading car.

2. Apparatus according to claim 1, wherein said roll preparation stations hold the rolls with their axes in a common line.

3. The apparatus according to claim 2, wherein the line of said roll axes in said roll preparation stations is parallel to the path of said loading car, and wherein said loading station comprises a turntable on which the axes of said rolls are turned 90° before the rolls are transferred onto said loading car.

4. Apparatus according to claim 3, wherein said loading station further comprises a gantry of a traveling crane for transferring the turned rolls onto said loading car.

5. Apparatus according to claim 1, wherein said loading station comprises roll lifting means by which the rolls can be brought to the level necessary for mounting in said roll stands even before their transfer to said loading car.

6. Apparatus according to claim 1, wherein said loading car includes height-adjustable roll support means for receiving the rolls, and continuous adjustment means for raising and lowering said roll support means.

7. Apparatus according to claim 6, further comprising level control means, situated along the track of said loading car for providing fine adjustment of the roll level on said loading car.

8. Apparatus according to claim 1, further comprising a track guided transport car for feeding the rolls successively to the individual roll preparation stations from a roll feeding station.

9. Apparatus according to claim 8, wherein said roll feeding station has an inclined ramp with at least one retractable stop for the rolls deposited on said ramp.

10. Apparatus according to claim 9, wherein said roll feeding station further comprises a turntable for turning the axes of said rolls.

11. Apparatus according to claim 1, wherein said means for removing the roll cores include at least one conveyor chain running between said pairs of roll stands and transfer means, associated with each individual pair of roll stands, for lowering the roll cores released from the roll stands onto said chain.

12. Apparatus according to claim 11, wherein said conveyor chain is guided, partially lowered in the floor, and is equipped with upwardly raised cleats.

13. Apparatus according to claim 11, wherein said transfer means include arms, associated with each pair of roll stands and means for moving one end of said arms upward from the floor to support the roll cores.

14. Apparatus according to claim 1, further comprising a pivoting beam and a pressure-applying means associated with each pair of roll stands, one of said means for holding the ends of the indrawn webs of material, one of said severing means and one of said pressure applying means being disposed together on each of said pivoting beams, said pivoting beams being moveable such that said severing means can be brought in contact with the outrunning web of material and the pressure applying means can be brought in contact with the circumferential surface of a newly mounted roll on a roll stand pair.

15. Apparatus according to claim 14, wherein said holding means include at least one suction member, said severing means include a knife and a cooperating anvil, and said pressure-applying means include a pressure roller.

16. Apparatus according to claim 14, wherein said pressure applying means can be moved back and forth on said pivoting beam.

17. Apparatus according to claim 14, further comprising a carriage disposed on each pivoting beam and having a deflecting member for deflecting the web of material, said deflecting member being capable of bringing the web into reach of said one holding means.

18. Apparatus according to claim 17, wherein said one severing means include a knife and a cooperating anvil, said anvil being disposed on said carriage.

19. Apparatus according to claim 1, wherein said holding means is automatically lowerable to circumferential surfaces of the mounted rolls and raisable again therefrom; and whererin said apparatus further comprises means, disposed adjacent to said holding means, for severing the webs of material running from said mounted rolls into said machine.

20. Apparatus according to claim 1, further comprising an unloading car which can likewise be run between said roll stand pairs to receive a single roll.

21. Apparatus according to claim 1, further comprising means for automaticaly controlling the entire roll change operation, from the removal of the empty roll cores, through the transfer of the new rolls from the loading car, to the splicing of the ends of the webs of material to the new rolls.

* * * * *